US008568644B2

(12) United States Patent
Kusawake et al.

(10) Patent No.: US 8,568,644 B2
(45) Date of Patent: Oct. 29, 2013

(54) METHOD FOR PRODUCING SOFT MAGNETIC MATERIAL AND METHOD FOR PRODUCING DUST CORE

(75) Inventors: Kazushi Kusawake, Itami (JP); Toru Maeda, Itami (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 119 days.

(21) Appl. No.: 12/994,672

(22) PCT Filed: Oct. 26, 2009

(86) PCT No.: PCT/JP2009/005635

§ 371 (c)(1), (2), (4) Date: Nov. 24, 2010

(87) PCT Pub. No.: WO2010/061525

PCT Pub. Date: Jun. 3, 2010

(65) Prior Publication Data

US 2011/0068506 A1 Mar. 24, 2011

(30) Foreign Application Priority Data

Nov. 26, 2008 (JP) ..... 2008-301637

(51) Int. Cl.
*B22F 1/00* (2006.01)
*H01F 1/24* (2006.01)

(52) U.S. Cl.
USPC ..... 264/319

(58) Field of Classification Search
CPC ..... B22F 1/0062; H01F 1/24
USPC ..... 264/319
See application file for complete search history.

(56) References Cited

U.S. PATENT DOCUMENTS 4,601,765 A * 7/1986 Soileau et al. ..... 148/104
6,054,219 A 4/2000 Satsu et al.

(Continued)

FOREIGN PATENT DOCUMENTS

CN 1725388 A 1/2006
CN 1883017 A 12/2006

(Continued)

OTHER PUBLICATIONS

Office Action in Chinese Patent Application No. 200980119137.6 dated Dec. 5, 2012.

(Continued)

*Primary Examiner* — Yogendra Gupta
*Assistant Examiner* — Alison Hindenlang
(74) *Attorney, Agent, or Firm* — Venable LLP; Michael A. Sartori; Tamatane J. Aga

(57) ABSTRACT

The invention offers a method for producing a soft magnetic material. The method effectively produces a soft magnetic material having soft magnetic metallic particles each coated with a plurality of insulating layers. A soft magnetic material to be used as the material for a dust core is produced through the following steps: a step of preparing a material powder having composite magnetic particles produced by forming an insulating film containing hydrated water on each of the surfaces of soft magnetic metallic particles, a step of preparing a resin material containing silicone that cures through a hydrolysis-polycondensation reaction, and a step of mixing the material powder and the resin material in a heated atmosphere at 80° C. to 150° C. to form a silicone film on the surface of the insulating film.

6 Claims, 2 Drawing Sheets

(56) References Cited

U.S. PATENT DOCUMENTS

| | | | |
|---|---|---|---|
| 7,544,417 | B2 | 6/2009 | Maeda et al. |
| 2007/0243400 | A1 | 10/2007 | Miyahara et al. |
| 2008/0003126 | A1 | 1/2008 | Watanabe et al. |

FOREIGN PATENT DOCUMENTS

| | | | | |
|---|---|---|---|---|
| CN | 101053047 | A | | 10/2007 |
| CN | 101300646 | A | | 11/2008 |
| JP | 2000-331814 | | | 11/2000 |
| JP | 2002-246219 | | | 8/2002 |
| JP | 2005-133168 | A | | 5/2005 |
| JP | 2006-028565 | A | | 2/2006 |
| JP | 2006028565 | A | * | 2/2006 |
| JP | 2006-202956 | A | | 8/2006 |
| JP | 2007-027480 | A | | 2/2007 |
| JP | 2007-092120 | A | | 4/2007 |
| JP | 2007-129045 | | | 5/2007 |
| JP | 3986043 | | | 7/2007 |
| JP | 2008-063652 | A | | 3/2008 |
| WO | WO-2005/043560 | A1 | | 5/2005 |
| WO | WO-2007/023627 | A1 | | 3/2007 |
| WO | WO-2007/052411 | A1 | | 5/2007 |
| WO | WO-2007/582411 | A2 | | 5/2007 |

OTHER PUBLICATIONS

Office Action in Japanese Patent Application No. 2010-047350 dated Feb. 1, 2013.

* cited by examiner

METHOD FOR PRODUCING SOFT MAGNETIC MATERIAL AND METHOD FOR PRODUCING DUST CORE

TECHNICAL FIELD

The present invention relates to a method for producing a soft magnetic material to be used as a material for a dust core and to a method for producing a dust core formed by using the soft magnetic material.

BACKGROUND ART

Hybrid cars and the like are provided with a booster circuit in their system for supplying electric power to the motor. The booster circuit includes a reactor as a component. The reactor has a structure in which a coil is wound around a core. When such a reactor is used in an alternating magnetic field, the core produces an energy loss known as an iron loss. Generally, the iron loss is expressed as the summation of a hysteresis loss and an eddy current loss and it becomes noticeable in the use at high frequency, in particular.

To decrease the above-described iron loss, the core of the reactor is sometimes formed by using a dust core. To form a dust core, first, a soft magnetic material is prepared that is composed of composite magnetic particles composed of soft magnetic metallic particles each coated with an insulating film. Then, the soft magnetic material is pressed to form the dust core. Because the metallic particles are insulated with one another with the insulating film, the dust core is highly effective in decreasing the eddy current loss, in particular.

Despite the above description, because the dust core is produced through the press molding, the pressure at the time of the press molding may damage the insulating films of the composite magnetic particles. When the insulating films are damaged, the soft magnetic metallic particles in the dust core are brought into contact with one another. This contact causes the eddy current loss to increase and thus may decrease the high-frequency property of the dust core.

In addition, strain and dislocation introduced into the soft magnetic metallic particles during the press molding cause an increase in the hysteresis loss. To prevent this increase, it is necessary to perform heat treatment after the press molding. The heat treatment, however, may deteriorate the insulating film, so that it is undesirable to perform the heat treatment at high temperature. When the heat treatment temperature is not sufficiently high, the strain and the like introduced into the metallic particles cannot be removed sufficiently. As a result, the hysteresis loss may increase, thereby decreasing the high-frequency property of the dust core.

To solve the problem caused by the press molding and heat treatment, a technique, for example, described in Patent Literature 1 forms on the surface of each of the soft magnetic metallic particles an insulating layer having multiple layers composed of an insulating film, a heat-resistance-imparting protective film, and a flexible protective film. According to the technique described in this literature, the insulating film may be formed of a phosphorus compound, a silicon compound, or the like, the heat-resistance-imparting protective film may be formed of an organic-silicon compound or the like, and the flexible protective film may be formed of silicone or the like.

CITATION LIST

Patent Literature

Patent Literature 1: the published Japanese patent application Tokukai 2006-202956.

SUMMARY OF INVENTION

Technical Problem

Despite the above description, the above-described technique has a problem in that the step of forming multiple layers composed of a plurality of insulating layers on the surface of each of the soft magnetic metallic particles is complicated, so that the productivity of the soft magnetic material is low.

When the multiple insulating layers are formed, the basic method is to form the insulating layers successively on the surface of each of the soft magnetic metallic particles. For example, the technique described in Patent Literature 1 shows the wet coating method as the method for forming the insulating layer. In the wet coating method, first, the object to be coated is immersed in an organic solvent dissolving an insulating material. The object is stirred and the organic solvent is evaporated. Subsequently, the insulating material is cured to form the insulating film on the surface of the object to be coated. In other words, the formation of the insulating film requires three steps of stirring, evaporation, and curing. As a result, the productivity of the soft magnetic material is low.

In addition, for example, when a silicone film is selected as the insulating layer to be formed on the object to be coated, the method described below may be employed. First, the object to be coated and silicone are mixed with a mixer. Then, polycondensation of the silicone is promoted in a heated atmosphere. Thus, the silicone film is formed on the surface of the object to be coated. In this case, the total step is decreased to two steps of the mixing of the materials and the heat treatment. Nevertheless, considering the formation of the multiple insulating layers on the surface of each of the soft magnetic metallic particles, it can be said that the method still has a large number of steps.

In view of the above circumstances, an object of the present invention is to offer a method for producing a soft magnetic material, the method being for effectively producing a soft magnetic material composed of soft magnetic metallic particles each coated with a plurality of insulating layers in order to suppress the decrease in the magnetic property caused by the press molding and heat treatment.

Another object of the present invention is to offer a method for producing a dust core, the method being for producing a dust core having excellent high-frequency property.

Solution to Problem

The present inventors have paid attention to the two insulating layers adjacent to each other in the thickness direction on the surface of each of the soft magnetic metallic particles and have found that the above-described object can be attained by limiting the structure of the two insulating layers. Based on this finding, the present invention is specified as described below.

The method for the present invention for producing a soft magnetic material is a method for producing a soft magnetic material to be used for producing a dust core and has the following steps:

(a) a step of preparing a material powder having composite magnetic particles that have:
  (a1) soft magnetic metallic particles, and
  (a2) an insulating film that contains hydrated water and that is formed on the surface of each of the soft magnetic metallic particles (hereinafter referred to as Step A),
(b) a step of preparing a resin material containing silicone that cures through a hydrolysis-polycondensation reaction (hereinafter referred to as Step B), and
(c) a step of mixing the material powder and the resin material in a heated atmosphere at 80° C. to 150° C. to form a silicone film on the surface of the insulating film (hereinafter referred to as Step C).

According to the method for the present invention for producing a soft magnetic material, it is possible to effectively produce in a short time a soft magnetic material composed of composite magnetic particles composed of soft magnetic metallic particles each coated with a plurality of insulating layers formed of an insulating film and a silicone film. The reason why the soft magnetic material can be produced effectively is that the hydrated water contained in the insulating film promotes the formation of the silicone film. A detailed mechanism is described later.

The method for the present invention for producing a dust core has the following steps:

(a) a step of press-molding the soft magnetic material produced through the above-described method for producing a soft magnetic material (hereinafter referred to as Step D), and
(b) a step of heat treatment in order to remove strain introduced into the soft magnetic metallic particles during the press molding (hereinafter referred to as Step E).

According to the method for the present invention for producing a dust core, after the soft magnetic material of the present invention is pressed and molded, high-temperature heat treatment is performed. Consequently, the strain and dislocation introduced into the metallic particles of the soft magnetic material during the pressing can be sufficiently removed. After being pressed, the soft magnetic material can be heat-treated at high temperature because the soft magnetic material is composed of composite magnetic particles composed of soft magnetic metallic particles each coated with the multiple insulating layers. The dust core from which the strain and the like are sufficiently removed has excellent energy efficiency because its iron loss is decreased. The dust core obtained as described above can be suitably used as the core of a reactor, for example.

A detailed explanation is given below to the constituting elements of the individual steps in the methods of the present invention for producing a soft magnetic material and a dust core.

Step A: Preparation of Material Powder

The material powder to be prepared is a congregation of composite magnetic particles produced by forming an insulating film containing hydrated water on each of the surfaces of soft magnetic metallic particles.

It is desirable that the soft magnetic metallic particles contain 50 mass % or more iron. The types of material of the metallic particles include pure iron (Fe), for example. In addition, the following iron alloys may be used, for example: Fe—Si-based alloy, Fe—Al-based alloy, Fe—N-based alloy, Fe—Ni-based alloy, Fe—C-based alloy, Fe—B-based alloy, Fe—Co-based alloy, Fe—P-based alloy, Fe—Ni—Co-based alloy, and Fe—Al—Si-based alloy. In particular, in terms of magnetic permeability and magnetic-flux density, it is desirable to use pure iron having 99 mass % or more Fe.

The present invention specifies that the soft magnetic metallic particles have an average particle diameter of 1 μm or more and 70 μm or less. When the soft magnetic metallic particles have an average particle diameter of 1 μm or more, this feature can suppress the increase in the magnetic coercive force and hysteresis loss of the dust core produced using the soft magnetic material without decreasing the fluidity of the soft magnetic material. On the other hand, when the soft magnetic metallic particles have an average particle diameter of 70 μm or less, this feature can effectively decrease the eddy current loss generated in a high-frequency region of 1 kHz or more. It is more desirable that the soft magnetic metallic particles have an average particle diameter of 50 μm or more and 70 μm or less. When the lower limit of the average particle diameter is 50 μm or more, not only can the decreasing effect of the eddy current loss be obtained but also the handling of the soft magnetic material becomes easy, so that a formed body having a higher density can be obtained. In the above description, the term "average particle diameter" means the particle diameter of the particle at which the summation of the masses from the particle having the smallest particle diameter reaches 50% of the total mass in the histogram of particle diameter, that is, 50% particle diameter.

It is desirable that the soft magnetic metallic particles each have the shape having an aspect ratio of 1.5 to 1.8. Soft magnetic metallic particles each having an aspect ratio in the foregoing range can, in comparison with ones each having a small aspect ratio (close to 1.0), form a dust core having a large demagnetizing factor and hence excellent high-frequency property. In addition, the dust core can have increased strength.

The insulating film covering the surface of each of the soft magnetic metallic particles acts as an insulating layer between the metallic particles. By covering each of the metallic particles with the insulating film, the metallic particles can be suppressed from being brought into contact with one another, so that the relative permeability of the formed body can be suppressed to a low value. Furthermore, the presence of the insulating film can suppress the eddy current from flowing across metallic particles, thereby decreasing the eddy current loss of the dust core.

The insulating film is not particularly limited providing that it contains hydrated water and has excellent insulating ability. For example, the insulating film can be suitably formed by using phosphate or titanate. In particular, an insulating film made of phosphate has excellent deformability. Consequently, even when the soft magnetic metallic particles are deformed at the time the dust core is produced by pressing the soft magnetic material, the insulating film can deform in response to the deformation of the metallic particles. Furthermore, the phosphate film has high ability to attain intimate contact with iron-based soft magnetic metallic particles, so that the film is less likely to be detached from the surface of the metallic particles. As the phosphate, the following metal phosphate compounds may be used: iron phosphate, manganese phosphate, zinc phosphate, and calcium phosphate. The insulating film containing hydrated water can be formed by using a material containing hydrated water.

It is desirable that the insulating film have a thickness of 10 nm or more and 1 μm or less. When the insulating film has a thickness of 10 nm or more, the metallic particles can be suppressed from being brought into contact with one another and the energy loss caused by the eddy current can be effectively suppressed. When the insulating film has a thickness of 1 μm or less, the proportion of the insulating film in the composite magnetic particles is not excessively large. This feature can prevent a noticeable decrease in the magnetic-flux density in the composite magnetic particles.

The above-described thickness of the insulating film can be examined through the method described below. First, the film thickness is derived by calculation using the composition of the film obtained through composition analysis (the transmission electron microscope-energy dispersive X-ray spectroscopy (TEM-EDX)) and the amount of element obtained through the inductively coupled plasma-mass spectrometry (ICP-MS). Then, the film is directly observed using a TEM photograph to confirm that the order of the film thickness previously derived by calculation has a proper value. This definition is also applied to the thickness of the silicone film described below.

Step B: Preparation of Resin Material

The resin material to be prepared is not particularly limited providing that the material is silicone that cures through a hydrolysis-polycondensation reaction. Typically, chemical compounds expressed as $Si_m(OR)_n$ (here, m and n are natural numbers) can be used. The chemical expression OR represents a hydrolyzable group. The types of hydrolyzable group include an alkoxy group, an acetoxy group, a halogen group, an isocyanate group, and a hydroxyl group. In particular, as the resin material, alkoxy oligomers can be suitably used whose molecular ends are blocked by an alkoxysilyl group (≡Si—OR). The types of alkoxy group include methoxy, ethoxy, propoxy, isopropoxy, butoxy, sec-butoxy, and tert-butoxy. In particular, considering the time and effort for removing the reaction product after the hydrolysis, it is desirable that the hydrolyzable group be methoxy. These resin materials may be used singly or in combination.

The silicone film formed through hydrolysis and polycondensation of the resin material has excellent deformability. Consequently, fracture and cracks are less likely to develop in the silicone film during the pressing of the soft magnetic material. The peeling of the silicone film off the surface of the insulating film is negligible. In addition, the silicone film has excellent heat resistance, so that even when the heat treatment is performed at high temperature after the soft magnetic material is press-molded, the silicone film can maintain excellent insulating ability.

Step C: Mixing of Material Powder and Resin Material

The mixing of the material powder and resin material is performed in a heated atmosphere at 80° C. to 150° C. The mixing creates a state in which the surface of each of the composite magnetic particles is covered with the resin material. At this moment, because of the heated atmosphere, hydrated water contained in the insulating film of the composite magnetic particles is desorbed to promote the hydrolysis of the resin material. The desorption of the hydrated water starts at about 80° C. As the temperature is increased, the rate of desorption increases, thereby promoting the hydrolysis-polycondensation reaction of the resin material. Consequently, it is desirable that the heated atmosphere be maintained at 100° C. to 150° C. The high temperature can facilitate the removal of the organic substance produced during the hydrolysis and polycondensation, for example, methanol in the case where the hydrolyzable group is methoxy.

Conventionally, heat treatment is performed after the materials are mixed, and the hydrolysis and polycondensation of the resin material are advanced by using water molecules contained in the heated atmosphere. On the other hand, in the method for the present invention for producing a soft magnetic material, because the insulating film that is the generating source of the water molecules is present directly under the resin material, the hydrolysis and polycondensation of the resin material are advanced in an extremely short time. For example, in the case of XC96-B0446 made by GE Toshiba Silicone Co., Ltd., conventionally, the heat treatment after the mixing is performed at 150° C. and for 60 minutes or more (the condition recommended by the resin manufacturer). In contrast, in the method for the present invention, the heating can be performed at 80° C. to 150° C. and for 10 to 30 minutes or so. Moreover, because the generating source of the water molecules is present in the vicinity of the resin material, even when the mixing is performed with a large batch in the order of several tens of kilograms, the resin material covering the surface of the insulating film can be reliably transformed into a silicone film.

The proportion for preparing the material powder and resin material can be properly selected in order to satisfy the property required of the dust core to be produced. In particular, in the case where the improvement of the DC current superimposition property is aimed at, it is desirable that the proportion of the resin material at the time of the mixing, i.e., the proportion of the resin material in the total amount of the material powder and the resin material, be 0.5 to 2.5 mass %. When the proportion of the resin material falls in the range of 0.5 to 2.5 mass %, the practically entire surface of each of the composite magnetic particles can be covered with the silicone film. As a result, the insulating ability between the soft magnetic metallic particles can be increased. In addition, the thickness of the formed silicone film can be increased in comparison with the conventional thickness. Consequently, at the time of the production of the dust core described below, the temperature of the heat treatment after the press molding can be increased.

The above-described desirable proportion of the resin material is larger than the proportion of the resin material in the conventional method for producing a soft magnetic material (0.25 mass % or so) (conventionally, the mixing and heat treatment are performed separately). The reason why the resin material can be mixed with the increased proportion is that the mixing in the heated atmosphere can promote the hydrolysis-polycondensation reaction of the resin material and that the organic substance produced during this reaction can be easily removed (for example, in the case where the hydrolyzable group is methoxy, the organic substance is methanol).

It is desirable that the silicone film have a thickness of 10 nm to 0.2 μm. When the silicone film has a thickness in this range, the insulation can be secured between the soft magnetic metallic particles without excessively decreasing the magnetic-flux density.

To promote the formation of the silicone film in the mixing step, a catalyst may be added. The usable types of the catalyst include organic acids, such as formic acid, maleic acid, fumaric acid, and acetic acid, and inorganic acids, such as hydrochloric acid, phosphoric acid, nitric acid, boric acid, and sulfuric acid. It is desirable that the amount of addition of the catalyst be selected properly because an excessive amount causes gelation of the resin material.

In the soft magnetic material produced as described above, the surface of each of the soft magnetic metallic particles is covered with the insulating film and silicone film. Consequently, even when the soft magnetic material is pressed and molded in Step D in the subsequent stage, the soft magnetic metallic particles are rarely brought into direct contact with one another. Because the silicone film is formed on the surface of each of the composite magnetic particles, even when the heat treatment is performed at high temperature in Step E in the subsequent stage, the insulating film can be suppressed from decomposing thermally, so that the contact between the soft magnetic metallic particles can be prevented effectively.

The present inventors have studied and revealed that the soft magnetic material of the present invention, which is obtained by performing the mixing of the material powder and resin material and the heat treatment simultaneously, has better magnetic property when used in a dust core than the conventional soft magnetic material, which is obtained by performing the heat treatment after the mixing is performed, even when the proportion of the resin material at the time of the mixing is the same. The likely reason for this is that because the mixing of the material powder and resin material and the formation of the silicone film through the heat treatment are conducted simultaneously, a silicone film having a relatively uniform thickness is formed.

Step D: Press Molding

Typically, the press molding step can be performed by placing the soft magnetic material obtained in Step C into a molding die having a specified shape and then by compacting it by applying a pressure. The pressure for this operation can be selected as appropriate. Nevertheless, for example, in the case where a dust core to be used as the core of a reactor is produced, it is desirable to select a pressure of about 900 to 1,300 MPa, more desirably 960 to 1,280 MPa.

Step E: Heat Treatment

Heat treatment is carried out to remove the strain, dislocation, and so on introduced into the soft magnetic metallic particles in Step D. As the heat-treatment temperature is increased, the efficiency of the removal of the strain can be increased. Consequently, it is desirable that the heat treatment be performed at a temperature of 400° C. or more, particularly desirably 550° C. or more, yet more desirably 650° C. or more. In view of the removal of the strain and the like in the metallic particles, the present invention specifies the upper limit of the temperature for the heat treatment at about 800° C. The above-described heat-treatment temperature enables the removal of not only the strain but also the lattice defect such as dislocation introduced into the metallic particles during the pressing. The reason why the heat-treatment temperature can be increased is that the soft magnetic material of the present invention has a silicone film having relatively high heat resistance. Because the high heat-treatment temperature enables the sufficient removal of the strain and dislocation introduced into the soft magnetic metallic particles, the hysteresis loss of the dust core can be decreased effectively.

Advantageous Effect of Invention

The method for the present invention for producing a soft magnetic material enables the highly productive production of a soft magnetic material having soft magnetic metallic particles each coated with an insulating film and a silicone film. Because the produced soft magnetic material has soft magnetic metallic particles each of which has the surface covered with an insulating film and a silicone film, the films are less likely to be damaged and consequently their insulating ability is also less likely to be decreased during the press molding and the heat treatment after the press molding.

In addition, according to the method for the present invention for producing a dust core, the high-temperature heat treatment after the press molding enables the production of a dust core in which the strain and the like are sufficiently removed. The dust core free from the strain and the like is low in energy loss when used at high frequency. Consequently, it can exhibit excellent property, for example, as the core of a reactor. When the dust core is used, for example, as the core of a reactor, because it has excellent DC current superimposition property, a gapless core can be actualized.

DESCRIPTION OF EMBODIMENTS

Figure 1:
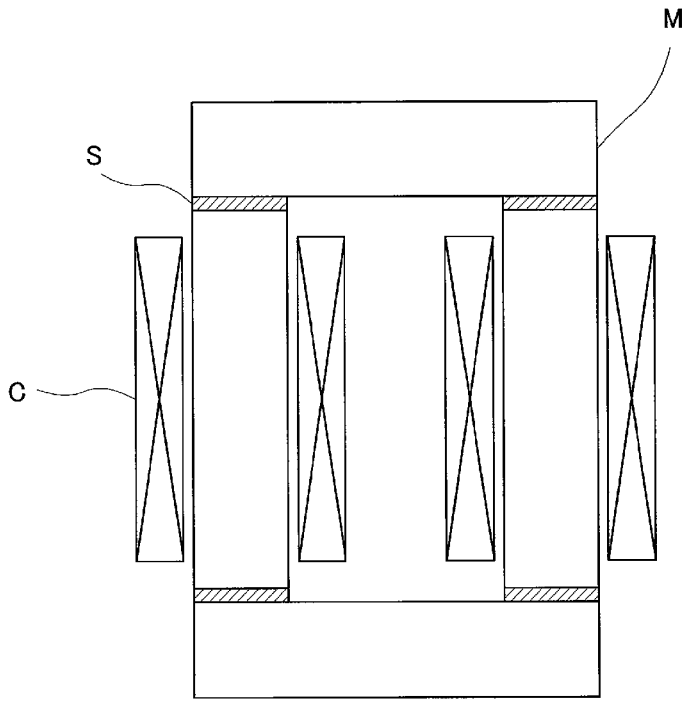
FIG. 1 is an illustration explaining the method for testing the DC current superimposition property.

Dust cores (Prototype material 1 and Prototype material 2) were produced through the method for the present invention for producing a dust core to measure their physical properties, the method having the steps (A) to (E) described below. In addition, a dust core (Comparative material) was produced through a conventional method for producing a dust core to measure its physical properties. Comparison was made on the physical properties of Prototype material 1, Prototype material 2, and Comparative material.

Production of Prototype Material 1

(A) A step of preparing a material powder composed of composite magnetic particles produced by forming an insulating film containing hydrated water on each of the surfaces of soft magnetic metallic particles.

(B) A step of preparing a resin material containing silicone that cures through a hydrolysis-polycondensation reaction in the presence of water.

(C) A step of mixing the material powder and the resin material in a heated atmosphere at 80° C. to 150° C. to form a silicone film on the surface of the insulating film.

(D) A step of press-molding a soft magnetic material composed of soft magnetic metallic particles each coated with an insulating film and a silicone film.

(E) A step of heat treatment in order to remove the strain introduced into the soft magnetic metallic particles during the press molding.

Step A

Irregularly shaped iron powders (average particle diameter: 50 μm, aspect ratio: 1.51) were prepared as the soft magnetic metallic particles, the iron powders being produced through the water atomization process and having a purity of 99.8% or more. The surface of the metallic particles was subjected to a phosphate chemical conversion treatment to form an insulating film composed of iron phosphate containing hydrated water. Thus, composite magnetic particles were produced. The practically entire surface of each of the soft magnetic metallic particles was covered with the insulating film. The insulating films had an average thickness of 50 nm. When the hydrated water contained in the insulating film was measured through the thermal desorption spectroscopy, its content was 7.78 mass %. The aggregation of the composite magnetic particles is the material powder for producing the soft magnetic material.

Step B

As the resin material containing silicone that cures through the hydrolysis-polycondensation reaction, TSR116 and XC96-B0446, both of which were made by GE Toshiba Silicone Co., Ltd., were prepared. They are alkoxy resin-type silicone oligomers whose molecular ends are blocked by an alkoxysilyl group (≡Si—OR), and the hydrolyzable group (—R) is methoxy. The order of Step A and Step B may be determined as appropriate.

Step C

The material powder prepared in Step A and the resin material (TSR116 and XC96-B0446) prepared in Step B were placed in a mixer. They were mixed for 10 minutes in a heated atmosphere at 150° C. to obtain the soft magnetic material. Of the materials placed in the mixer, TSR116 had a proportion of 0.75 mass % and XC96-B0446 had a proportion of 0.5 mass %. The number of revolutions of the mixer was 300 rpm.

Step C produced the soft magnetic material in which each of the composite magnetic particles was coated with a silicone film. The silicone films that were formed on the surfaces of the composite magnetic particles had an average thickness of 200 nm.

Step D

The soft magnetic material obtained in Step C was placed in a molding die having a specified shape. The press-molding of the soft magnetic material at a pressure of 960 MPa produced a bar-shaped specimen and a ring-shaped specimen. The dimensions of the specimens were as follows:

The bar-shaped specimen: for the evaluation of DC current superimposition property length: 55 mm; width: 10 mm; thickness: 7.5 mm The ring-shaped specimen: for the evaluation of magnetic property outer diameter: 34 mm; inner diameter: 20 mm; thickness: 5 mm Step E The bar-shaped specimen and ring-shaped specimen obtained in Step D were heat-treated for one hour at 600° C. in a nitrogen atmosphere. The specimen having undergone the heat treatment is the so-called dust core.

Production of Prototype Material 2

Prototype material 2 differs from Prototype material 1 in the points described below. In Step C, the resin material had a proportion of 0.25 mass % (the ratio between TSR116 and XC96-B0446 was the same as that in Prototype material 1). In this case, the silicone films had an average thickness of 100 nm.

As in Prototype material 1, in Prototype material 2, a bar-shaped specimen and a ring-shaped specimen were produced to measure DC current superimposition property and magnetic property.

Production of Comparative Material

Comparative material differs from Prototype material 1 in the points described below.

1. In Step C, the resin material had a proportion of 0.25 mass % (the ratio between TSR116 and XC96-B0446 was the same as that in Prototype material 1). In this case, the silicone films had an average thickness of 100 nm.

2. After the mixing of the material powder and the resin material for 10 minutes, the silicone film was formed through heat treatment for 60 minutes at 150° C. In other words, despite the smaller amount of the resin material to be cured, the total production time of the soft magnetic material for Comparative material is 60-minutes longer than that for Proto-type material 1. It is anticipated that when the number of soft magnetic materials to be produced is increased, the difference in the production time becomes more noticeable.

As in Prototype materials 1 and 2, in Comparative material, a bar-shaped specimen and a ring-shaped specimen were produced to measure DC current superimposition property and magnetic property.

Evaluation

Prototype materials 1 and 2 and Comparative material produced as described above were subjected to measurement of properties described below. The measured properties are summarized in Tables I and II described later.

Magnetic Property

A magnetic field of 100 Oe (≈7,958 A/m) was applied to a bar-shaped specimen to measure the magnetic-flux density $B_{100}$.

A ring-shaped specimen was provided with a winding to form a measuring sample for measuring the magnetic property of the specimen. The measuring sample was subjected to measurement of the iron loss W1/10 k (W/kg) at an excitation flux density, Bm, of 1 kG (=0.1 T) and a measuring frequency of 10 kHz and the iron loss W2/10 k (W/kg) at an excitation flux density, Bm, of 2 kG (=0.2 T) and a measuring frequency of 10 kHz. The measurement was carried out using an AC-BH tracer. In addition, a fitting on the frequency curve of the iron loss was conducted using the least-square method based on the three equations shown below to calculate the hysteresis loss coefficient Kh (mWs/kg) and the eddy current loss coefficient Ke ($mWs^2/kg$).

(iron loss)=(hysteresis loss)+(eddy current loss)

(hysteresis loss)=(hysteresis loss coefficient)×(frequency)

(eddy current loss)=(eddy current loss coefficient)×(frequency)$^2$

The measuring sample was also used to measure the initial permeability μi (H/m). The initial permeability was measured using a DC/AC-BH tracer (made by METRON Inc.).

Density

The submerged densities ($g/cm^3$) of the bar-shaped specimen and ring-shaped specimen were measured. The measurements confirmed that both specimens had the same density.

Electrical Resistance

Electrical resistance (Ω) was measured on the ring-shaped specimen through the four-terminal method.

DC Current Superimposition Property

As shown in FIG. 1, a core M composed of bar-shaped specimens was combined with spacers S, and a coil C was wound around the core M. Thus, a test assembly for measuring the DC current superimposition property was produced. In the test assembly, the number of turns of the coil was 54, the magnetic-path length was 220 mm, and the cross-sectional area of the magnetic path was 75 $mm^2$. In the test assembly, it was possible to vary the length of the gap existing in the core M by changing the total thickness of the spacers S. In this test, the inductance L (μH) of the test assembly incorporating the core M formed of Prototype material 1 was measured with the varied gap lengths of 0, 0.6, 1.2, 2.0, 2.8, and 4.0 mm and by varying the superimposed DC current from 0 to 40.0 A for each gap length. In addition, the inductance L (μH) of the test assembly incorporating the core M formed of Comparative material was measured with a gap length of 2.0 mm and by varying the superimposed DC current from 0 to 40.0 A.

Figure 2:
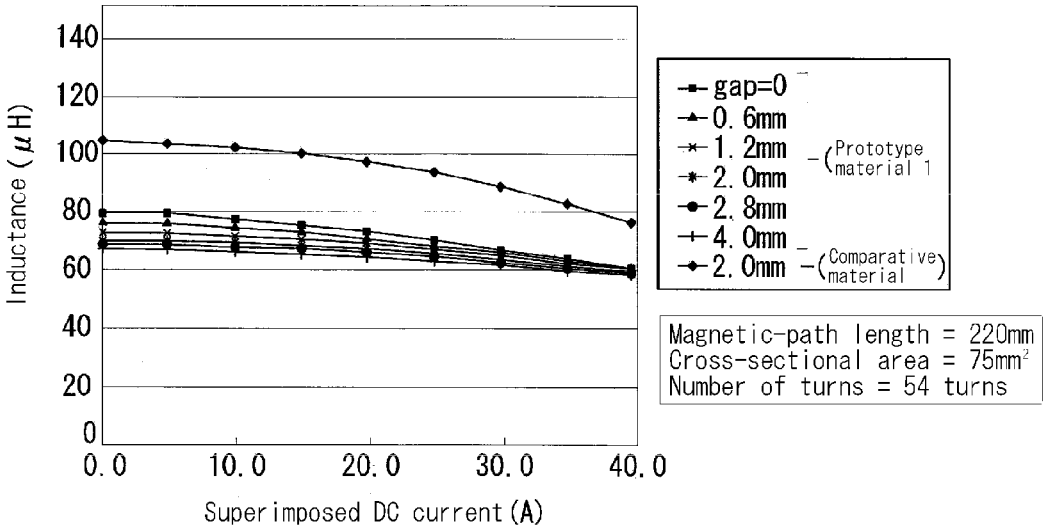
FIG. 2 is a graph showing the test result of the DC current superimposition property, in which the horizontal axis shows the superimposed DC current (A) and the vertical axis shows the inductance (μH).

FIG. 2 is a graph showing the measured values of the inductance of the test assembly (Prototype material 1 and Comparative material) for the individual superimposed DC currents. The DC current superimposition property is ranked as poorer when the superimposed DC current is increased, if the inductance L decreases more considerably from the inductance L at the time the superimposed current is zero ampere.

Figure 3:
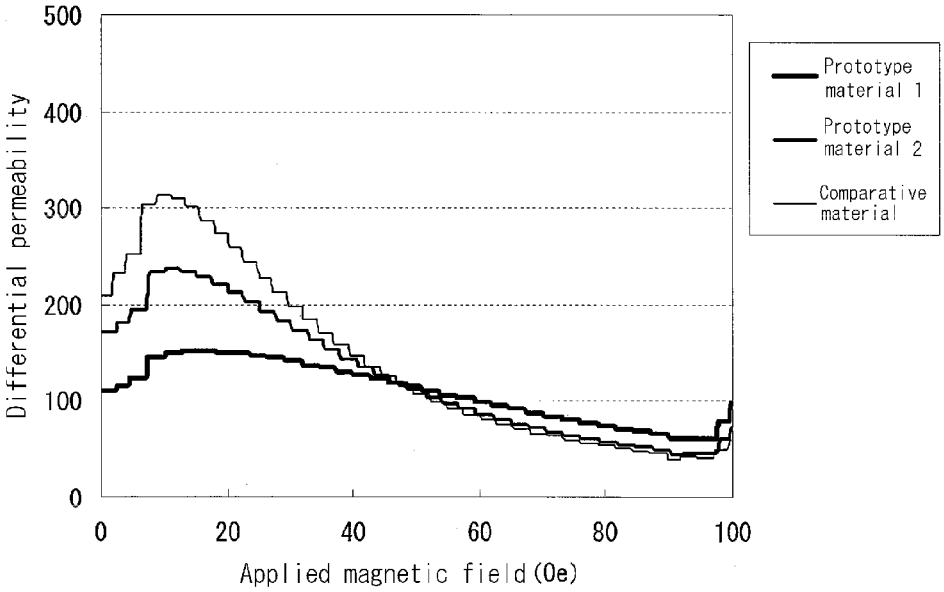
FIG. 3 is a graph showing the DC current superimposition property, in which the horizontal axis shows the applied magnetic field (Oe) and the vertical axis shows the differential permeability.

In addition, to more clearly evaluate the difference in the DC current superimposition property between the individual test samples, the differential permeability (ΔB/ΔH) of the individual test samples was measured. The differential permeability was obtained through the method described below. First, the measuring sample was formed by providing the ring-shaped specimen of the individual test samples with a winding. The DC magnetization property of the measuring sample was measured at an applied magnetic field of 100 Oe. The differential permeability was calculated based on the measured value. FIG. 3 shows the relationship between the applied magnetic field and the differential permeability for Prototype material 1, Prototype material 2, and Comparative material. In this case, when the difference between the maximum value and the minimum value in the differential permeability is smaller, the DC current superimposition property is better.

TABLE I

| | Density ($g/cm^3$) | Electrical resistance (Ω) | Magnetic-flux density $B_{100}$ (T) | Initial permeability μi (H/m) |
|---|---|---|---|---|
| Prototype material 1 | 6.9 | 6000 | 0.85 | 98 |
| Prototype material 2 | 7.6 | 3300 | 1.44 | 190 |
| Comparative material | 7.5 | 2000 | 1.4 | 205 |

TABLE II

| | Hysteresis loss coefficient Kh (mWs/kg) (when Bm = 0.1 T) | Eddy current loss coefficient Ke ($mWs^2/kg$) (when Bm = 0.1 T) | Iron loss W1/10k (W/kg) | Iron loss W2/10k (W/kg) |
|---|---|---|---|---|
| Prototype material 1 | 2.7 | $3.2 \times 10^{-5}$ | 30 | 106 |
| Prototype material 2 | 1.7 | $3.1 \times 10^{-5}$ | 18 | 74 |
| Comparative material | 1.6 | $3.2 \times 10^{-5}$ | 19 | 77 |

Evaluation Result

As can be seen from the results shown in Tables I and II, because in Prototype materials 1 and 2 and Comparative material, the insulation between the composite magnetic particles is secured, both the hysteresis loss coefficient Kh and the eddy current loss coefficient Ke are small and consequently the iron loss is suppressed to a low value. Because Prototype material 2 has the insulating film composed of iron phosphate and the silicone film both having the same thickness as that of Comparative material, it has properties comparable to those of Comparative material. On the other hand, because Prototype material 1 has the silicone film having a thickness thicker than that of Comparative material, it has lower $B_{100}$ and μi and higher values in the iron loss and the like than those of Comparative material. The values of Prototype materials 1 and 2 and Comparative material are far better than those of a material that is produced by forming only a phosphate film on the surface of each of the soft magnetic metallic particles (the data is not shown). In other words, it can be said that a dust core produced by using a soft magnetic material composed of the soft magnetic metallic particles each coated with a phosphate film and a silicone film has excellent high-frequency properties.

As can be seen from the result shown in FIG. 2, in Prototype material 1, when the superimposed current is varied from 0 A to 40.0 A, the decrease in the inductance is small in comparison with Comparative material. This result proves that Prototype material 1 has excellent DC current superimposition property. The probable reason for this is that because Prototype material 1 has the silicone film that is thicker and more uniform than that of Comparative material, Prototype material 1 has a larger electrical resistance and smaller magnetic permeability than those of Comparative material. Consequently, when the core for a reactor is produced using a dust core having a structure as formed in Prototype material 1, it is possible to omit the gap for adjusting the inductance.

As can be seen from the result shown in FIG. 3, despite the fact that both Prototype material 2 and Comparative material have the same amount of addition of resin material, Prototype material 2 is stabler in the DC current superimposition property of the inductance than Comparative material is. Because Prototype material 2 differs from Comparative material only in the method of forming the silicone film, this result reveals that the method for the present invention for producing a soft magnetic material is better than the conventional method in terms of improving the DC current superimposition property of the soft magnetic material. This result also unveils that Prototype material 1, in which the proportion of the resin material in Step C is 1.25 mass %, has better DC current superimposition property than that of Prototype material 2, in which the proportion is 0.25 mass %.

Embodiments of the present invention are not limited to the above-described ones, and they can be modified as appropriate in the scope that does not deviate from the main point of the present invention.

INDUSTRIAL APPLICABILITY

The soft magnetic material produced through the method for the present invention for producing a soft magnetic material can be suitably applied to the production of a dust core having excellent high-frequency property and DC current superimposition property.

REFERENCE SIGNS LIST

M: Core; C: Coil; and S: Spacer

The invention claimed is:

1. A method for producing a soft magnetic material to be used for producing a dust core, the method comprising the steps of:

(a) preparing a material powder comprising composite magnetic particles that comprise:

(a1) soft magnetic metallic particles; and (a2) an insulating film that contains hydrated water and that is formed on the surface of each of the soft magnetic metallic particles;

(b) preparing a resin material containing silicone that cures through a hydrolysis-polycondensation reaction; and (c) mixing the material powder and the resin material in a heated atmosphere at 80° C. to 150° C. to form a silicone film by the hydrolysis-polycondensation reaction on the surface of the insulating film, wherein the hydrated water contained in the insulating film is desorbed to promote hydrolysis of the resin material.

2. The method for producing a soft magnetic material as defined by claim 1, wherein in the step of mixing, the proportion of the resin material is 0.5 to 2.5 mass %.

3. The method for producing a soft magnetic material as defined by claim 1, wherein the soft magnetic metallic particles have an average particle diameter of 1 μm or more and 70 μm or less.

4. The method for producing a soft magnetic material as defined by claim 1, wherein the soft magnetic metallic particles each have an aspect ratio of 1.5 to 1.8.

5. The method for producing a soft magnetic material as defined by claim 1, wherein the insulating film is a phosphate film.

6. A method for producing a dust core, the method comprising the steps of:

(a) press-molding the soft magnetic material produced through the method for producing a soft magnetic material as defined by claim 1; and (b) heat treatment in order to remove strain introduced into the soft magnetic metallic particles during the press molding.

* * * * *